United States Patent [19]

Garneau

[11] Patent Number: 4,527,741

[45] Date of Patent: Jul. 9, 1985

[54] TRIGGER PUMP SPRAYER

[75] Inventor: Richard P. Garneau, Davie, Fla.

[73] Assignee: The AFA Corporation, Hialeah, Fla.

[21] Appl. No.: 503,907

[22] Filed: Jun. 13, 1983

[51] Int. Cl.[3] ..... B05B 9/043

[52] U.S. Cl. ..... 239/333; 222/383

[58] Field of Search ..... 239/329, 333, 334, 331; 222/590, 592, 594, 380, 383–385, 496

[56] References Cited

U.S. PATENT DOCUMENTS

| | | | |
|---|---|---|---|
| 2,912,999 | 11/1959 | Kersh | 137/512.4 |
| 2,913,000 | 11/1959 | Roberts | 137/525 |
| 2,949,929 | 8/1960 | Moors et al. | 137/516.29 |
| 3,061,202 | 10/1962 | Tyler | 239/333 |
| 3,250,214 | 5/1966 | McCarty et al. | 103/53 |
| 3,473,561 | 10/1969 | Svenson et al. | 137/525 |
| 3,476,142 | 11/1969 | Schultz | 137/512 |
| 3,587,940 | 6/1971 | Ellis | 222/383 |
| 3,626,978 | 12/1971 | Hoekstra | 137/525.3 |
| 3,685,739 | 8/1972 | Vanier | 239/333 |
| 4,234,128 | 11/1980 | Quinn et al. | 239/478 |
| 4,307,731 | 12/1981 | Kaufman | 128/766 |
| 4,365,751 | 12/1982 | Saito et al. | 239/333 |
| 4,402,432 | 9/1983 | Corsette | 222/383 X |

*Primary Examiner*—Andres Kashnikow
*Assistant Examiner*—Kevin Patrick Weldon
*Attorney, Agent, or Firm*—Thomas R. Vigil

[57] ABSTRACT

The trigger sprayer comprises a body having an upper horizontally extending portion and a lower generally vertically extending portion. The body has a passageway therein extending from one end of the upper portion to the bottom of the lower portion. A cylindrical hollow and a cylindrical cavity extend into the lower body portion from the bottom thereof. An insert member is adapted to be received in the hollow and cavity, and has a passageway therethrough communicating with the body passageway, a cap coupled to the lower end of the insert member to a container of fluid. A check valve assembly is associated with the insert member to a container of fluid. A check valve assembly is associated with the insert member passageway and includes a lower check valve. At least one of the valves including an elongate valve member and a frusto-conical shaped skirt extending forwardly from the valve member. A pumping assembly is mounted to the body and communicates with the insert member passageway between the upper and lower check valves.

26 Claims, 3 Drawing Figures

TRIGGER PUMP SPRAYER

BACKGROUND OF THE INVENTION

1. Field of the Invention

The present invention relates to a trigger sprayer of the type which is mounted to the top of a container of liquid and which has a trigger handle which can be squeezed to cause pumping and dispensing of liquid from a nozzle of the sprayer which has an off position and a stream position and/or spray mist position.

Such trigger sprayers have found wide application for the dispensing of cleaning fluids, such as liquids for cleaning windows or for dispensing water in a spray mist on plants, for example.

2. Description of the Prior Art

Heretofore, many many trigger sprayers have been proposed for pumping and dispensing liquid in a spray mist or stream from a bottle or other container.

With the discovery of the effect of fluorocarbons on the ozone layer in the atmosphere, the trend in the spray container industry has been away from aerosol operated spray containers and toward trigger sprayers which utilize a manually operating pump without the use of fluorocarbons.

Thus, over the last fifteen years, a large number of patents have been granted on various innovations, improvements and modifications to trigger sprayers with a view toward providing a simple, inexpensive trigger sprayer which will function effectively as a closure for the container and also as a metering device for dispensing fluid in a spray mist or stream.

Examples of a large number of, but by far not all of, the trigger sprayer constructions previously proposed, are disclosed in the following U.S. patents:

| U.S. PAT. NO. | PATENTEE |
|---|---|
| 2,699,271 | Davis |
| 3,061,202 | Tyler |
| 3,062,416 | Cooprider |
| 3,130,877 | Miller |
| 3,149,755 | Porter et al |
| 3,185,355 | Lipman |
| 3,486,663 | Humphrey |
| 3,650,473 | Malone |
| 3,685,739 | Vanier |
| 3,701,478 | Tada |
| 3,726,442 | Davidson et al |
| 3,749,290 | Micallef |
| 3,762,647 | Tada |
| 3,768,734 | Anderson, Jr. et al |
| 3,770,206 | Tada |
| 3,780,951 | Powers |
| 3,840,157 | Hellenkamp |
| 3,843,030 | Micallef |
| 3,897,006 | Tada |
| 3,967,765 | Micallef |
| 3,973,700 | Schmidt et al |
| 3,986,644 | Grogan et al |
| 3,987,938 | Cooprider et al |
| 3,995,774 | Cooprider et al |
| 4,013,228 | Schneider |
| 4,072,252 | Steyns et al |
| 4,082,223 | Nozawa |
| 4,109,869 | Brockelsby et al |
| 4,138,038 | Grogan |
| 4,153,203 | Tada |
| 4,155,487 | Blake |
| 4,161,288 | McKinney |
| 4,168,788 | Quinn |
| 4,183,449 | Blake |
| 4,191,313 | Blake et al |
| 4,201,317 | Aleff |

-continued

| U.S. PAT. NO. | PATENTEE |
|---|---|
| 4,204,614 | Reeve |
| 4,222,501 | Hammett et al |
| 4,225,061 | Blake et al |
| 4,227,650 | McKinney |
| 4,230,277 | Tada |
| 4,234,128 | Quinn et al |
| 4,241,853 | Pauls et al |
| 4,247,048 | Hayes |
| 4,257,539 | Cary et al |
| 4,260,079 | Cary et al |
| 4,260,082 | Rooney et al |
| 4,313,568 | Shay |
| 4,340,158 | Ford et al |
| French Patent No. 1,333,491 | M. Pasteur |

As will be described in greater detail hereinafter, the trigger sprayer of the present invention has a number of features which provide a more efficient and effective trigger sprayer that is also more economical and less expensive to manufacture than previously proposed trigger sprayers.

Certain of the features are novel per se and others of the features are similar to features previously proposed in prior trigger sprayer constructions.

For example, the provision of an adjustable or multiple purpose nozzle assembly is disclosed in the Quinn et al U.S. Pat. No. 4,234,128 and the Micallef U.S. Pat. Nos. 3,843,030 and 3,967,765.

Other adjustable or removable nozzles are disclosed in the Shay U.S. Pat. No. 4,313,568, the Reeve U.S. Pat. No. 4,204,614 and the Pauls et al U.S. Pat. No. 4,241,853.

Liquid dispensers utilizing upper and lower in-line ball type check valves are disclosed in the Cooprider U.S. Pat. No. 3,062,416, the Hammett et al U.S. Pat. No. 4,222,501, and the Ford et al U.S. Pat. No. 4,340,158.

Other dispensers using two ball type check valves are disclosed in the Pasteur French Pat. No. 1,333,491 and in the Davis U.S. Pat. No. 2,699,271.

A seating and retaining structure on the back side of a trigger handle for the forward end of a plunger or piston in a trigger sprayer are disclosed in the Tada U.S. Pat. No. 4,153,203 and in the Cary et al U.S. Pat. No. 4,260,079.

Other types of plunger-trigger handle couplings are disclosed in the Tyler U.S. Pat. No. 3,061,202, the Malone U.S. Pat. No. 3,650,473, the Vanier U.S. Pat. No. 3,685,739 and the Steyns et al U.S. Pat. No. 4,072,252.

Guide pins, rods or posts for a biasing spring in a trigger sprayer are disclosed in the Tyler U.S. Pat. No. 3,061,202, the Tada U.S. Pat. No. 3,701,478, the Tada U.S. Pat. No. 3,770,206, the Malone U.S. Pat. No. 3,650,473, the Vanier U.S. Pat. No. 3,685,739 and the Steyns et al U.S. Pat. No. 4,072,252.

Moreover, various flap type valves in trigger sprayers are disclosed in the Miller U.S. Pat. No. 3,130,871, the Humphrey U.S. Pat. No. 3,486,663, the Davidson et al U.S. Pat. No. 3,726,442, the Micallef U.S. Pat. No. 3,749,290, the Schmidt et al U.S. Pat. No. 3,973,700, the Grogan U.S. Pat. No. 3,986,644, the Cooprider et al U.S. Pat. No. 3,987,938, the Cooprider et al U.S. Pat. No. 3,995,774, the Alef U.S. Pat. No. 4,201,317 and the Blake et al U.S. Pat. No. 4,225,061. Note also the O-ring valve disclosed in U.S. Pat. No. 3,768,734.

Venting of a bottle on a pumping stroke in a trigger sprayer without affecting the seal between a sprayer cap and the bottle is disclosed in Steyns U.S. Pat. No. 4,072,252.

Finally, eccentric or off-center mounting of a dip tube in a trigger sprayer is disclosed in the Grogan U.S. Pat. No. 4,138,038, the Blake U.S. Pat. No. 4,155,487 and the Reeve U.S. Pat. No. 4,204,614.

As will be described in greater detail hereinafter, the trigger sprayer of the present invention provides a simple, inexpensive sprayer construction which in one embodiment, includes a novel plastic valve element which has a frusto-conical skirt or umbrella-like configuration, frictionally and sealingly engaging with the cylindrical wall of a bore in a body of the sprayer and being deflectable radially inwardly by fluid being pumped so as to allow the pumped fluid to pass around the skirt or umbrella-like configuration.

Further, the trigger sprayer comprises a simple, body member which is configured to receive a nozzle bushing which is adapted to mount a removable and positionable nozzle which can have one, two or three positions, such as an off position, a spray mist position, or a stream discharge position.

Still further, the lower body portion of the body has a cylindrical hollow and a cylindrical cavity for receiving one shape of insert member which can have one of several internal configurations and a horizontally extending cavity for receiving a piston, or an insert sleeve and a piston, with a trigger handle pivotally mounted to the body and slidably engagable with the forward end of the piston.

SUMMARY OF THE INVENTION

According to the invention there is provided, a valve and pumping assembly for use in a trigger sprayer comprising: a body having a bore therein including a linear passageway having first and second ends with said first end adapted for connection to a source of fluid to be dispensed and a second end adapted for connection to an outlet through which fluid is to be dispensed, said passageway having a cylindrical wall, said wall having an opening therethrough for connection of the ends of said passageway to a pump chamber, said valve and pumping assembly comprising: first check valve means in said passageway between said first end thereof and said opening for permitting forward flow of fluid from the source but not reverse flow to the source, second check valve means in said passageway adjacent said second end thereof for permitting forward flow of fluid to said outlet but not reverse flow to said pump chamber, said second check valve means comprising a stationary flexible frusto-conical shaped skirt member having outer marginal edges thereof in engagement with said cylindrical wall of said passageway, and pumping means comprising a piston received in said pump chamber, a spring in said pump chamber between an inner end thereof and an inner end of said piston for biasing said piston outwardly of said pump chamber, and trigger means which are pivotally connected to the body which are engagable with an outer end of said piston and which are hand manipulatable for pushing said piston into said pump chamber against the action of said spring thereby to force fluid in said pump chamber from said pump chamber through said opening into said bore and past said second check valve means to the outlet, on an inner stroke of said piston, and, on an outer stroke of said piston, to draw fluid into said pump chamber from the source through said first check valve means.

Further, according to the invention there is provided for use in a trigger sprayer, having a body, a nozzle coupled to said body, passage means in said body defining a fluid path to said nozzle, means for coupling said body to a container and communicating the interior of the container with said passage means, a pumping chamber in said body, an opening communicating said passage means with said pumping chamber and pumping means mounted to said body and received in said pumping chamber for pumping fluid from the container to said nozzle, a check valve assembly in said passage means for controlling delivery of fluid to said nozzle, said check valve assembly including a bore in said passage means, first valve means in said passage means between the container and said opening, and second valve means between said opening and said nozzle, said second valve means including an elongate valve member in said bore, and a frusto-conical shaped skirt extending radially outwardly and axially of said valve member in the downstream direction of the flow of fluid through said bore and in frictional, sealing engagement with said bore but yet being flexible so as to be able to deflect inwardly under fluid pressure to allow pumped fluid to flow past said skirt to said nozzle.

Also, according to the invention, there is provided a trigger sprayer comprising a body having an upper generally horizontally extending portion and a lower generally vertically extending portion, said body having passage means therein extending from one end of said upper portion to the bottom of said lower portion for providing a fluid flow path through said body, a first cylindrical cavity extending into said lower body portion from the underside thereof, an insert member adapted to be received in said first cavity and having a passageway therethrough communicating with said body passage means, means for coupling the lower end of said insert member to a container of fluid, a check valve assembly associated with said passageway including lower check valve means for permitting fluid flow upwardly therethrough from the container to which said insert member is coupled, and upper check valve means for permitting fluid flow upwardly through said passage means to said one end of said upper body portion, and pumping means mounted to said body and communicating with said passageway between said upper and lower check valve means, said lower body portion having a second generally cylindrical cavity therein, said body insert member having second passage means therethrough communicating the interior of said second cylindrical cavity with said passageway and said insert member, and said pumping means comprising a piston received in said second cavity, a spring in said second cavity between an inner end thereof and an inner end of said piston for biasing said piston outwardly of said second cavity, and trigger means which are pivotally connected to said body and engagable with an outer end of said piston and which are hand manipulatable for pushing said piston into said second cavity against the action of said spring thereby to force fluid in said second cavity, on an inner stroke of said piston, from said second cavity into said passageway and past said upper check valve means to said one end of said upper body portion, and on an outer stroke of said piston, to draw fluid into said second cavity from the container through said lower check valve means.

Still further, according to the invention, the pumping means mounted to and formed in said body includes a generally cylindrical cavity in the body having a port opening in the bottom wall of said cavity for communicating with the check valve assembly with the cavity being adapted to receive a piston therein which when pushed into the cavity, generates a standard spray or an insert therein for receiving a smaller diameter piston which creates a higher pressure when the piston is moved within the insert in the cavity to generate a fine mist spray.

Still further according to the invention, four different nozzle assemblies can be provided. One nozzle assembly would be a standard spray nozzle with three positions, an off position, a spray position and a stream position. Another standard spray nozzle would have two positions, namely, an off position and a spray or stream position. Then a fine mist spray nozzle having a smaller outlet orifice and having either the three positions or the two positions referred to above can be provided.

Thus, with four types of nozzle assemblies available, two types of piston assemblies available and two types of check valve assemblies available, thirty-two possible assembly combinations are provided with the trigger sprayer of the present invention.

DESCRIPTION OF THE PREFERRED EMBODIMENTS

Figure 1:
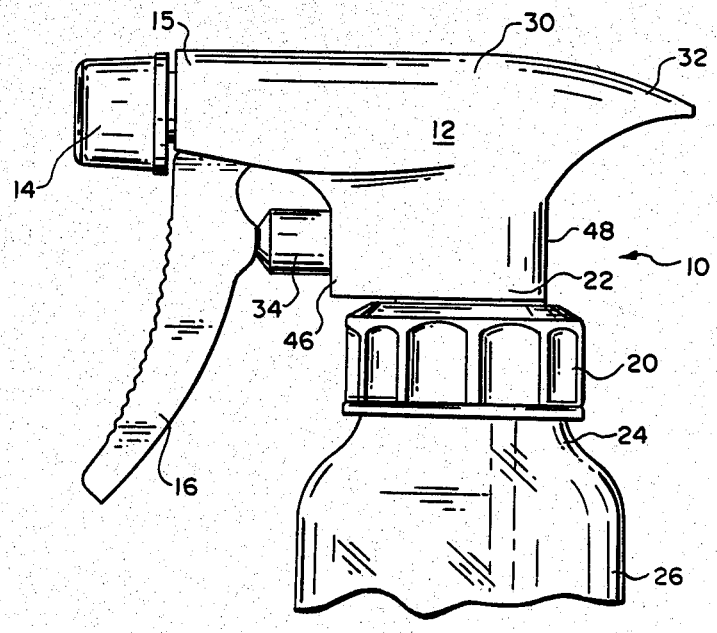
FIG. 1 is a side elevational view of the trigger sprayer of the present invention.

Referring now to FIG. 1 in greater detail, there is illustrated therein, a trigger sprayer generally identified by the reference numeral 10. The sprayer 10 includes a body 12, a nozzle assembly 14 coupled to an outlet end 15 of body 12, a trigger handle 16 pivotally mounted internally of body 12, and a cap 20 coupled to an inlet end 22 of the body 12 and adapted to be connected to a neck 24 of a container or bottle 26.

As shown, the body 12 has a generally T-shape with a wide downwardly extending lower body portion 28 extending to the inlet end 22 connected to cap 20, and a horizontally extending upper body portion 30 having the outlet end 13 at one end thereof and a fairing or shroud 32 at the other end thereof. The shape of body 12 can, of course, have any desired shape and is not limited to a T-shape.

A piston or plunger 34 extends from the lower body portion 28 as shown in FIG. 1 and has a rounded yolk 36 (FIG. 2) in engagement with a seat formation 38 formed on back side 40 of the trigger handle 16. An inner portion 42 (FIG. 2) of the piston 34 is received in a cylindrical cavity 44 (FIG. 2) extending from a front side 46 of the lower body portion 28 generally horizontally into the lower body portion 28. A back side 48 of lower body portion 28 is rounded and forms with the trigger handle 16, a gripping formation by which a user of the trigger sprayer 10 can grip the sprayer 10 with one hand and squeeze to cause the trigger handle 16 to push the piston 34 into the cavity 44 against the force of a biasing spring 50 (FIG. 2) in the cavity 44.

As will be described in greater detail hereinafter, squeezing of the trigger handle 16 will cause liquid to be expressed in a spray from the nozzle assembly 14 and on release of the handle 16, the spring 50, acting against the piston 34 and urging it outwardly, causes liquid to be drawn into the cavity 44 in the lower body portion 28.

Figure 2:
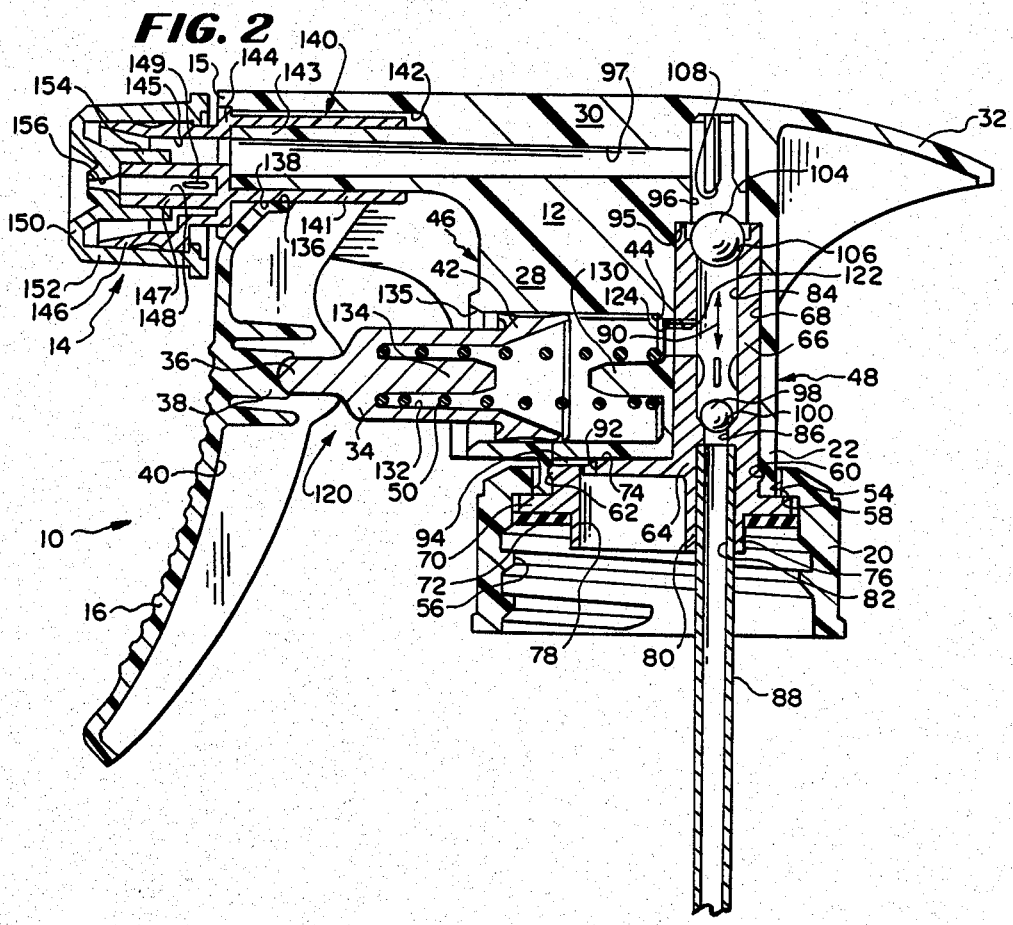
FIG. 2 is a vertical cross-sectional view of one embodiment of the trigger sprayer shown in FIG. 1 and shows a valving system employing two balls.

Referring now to FIG. 2, the inlet end 22 at the bottom of lower body portion 28 has a generally cylindrical, depending rim or flange 52 which extends into a cylindrical opening 54 in cap 20. The opening 54 extends to and communicates with a larger-in-diameter threaded cylindrical wall surface 56 where a shoulder 58 is formed between opening 54 and the cylindrical cavity defined by wall surface 56. Wall surface 56 is threadedly received on the threaded neck 24 of container 26.

The inside wall of the depending rim 52 has an annular groove 60 in which is snap-fittingly received an annular detent 62 on an insert member 64.

The insert member 64 is specially configured, as will be described further below, and is press-fitted into the cylindrical hollow within the depending rim 52 and has an upstanding cylindrical boss 66 which is received in a generally, vertically disposed, cylindrical cavity 68 extending upwardly from the bottom or inlet end 22 of lower body portion 28 into lower body portion 28.

The insert member 64 is generally cylindrical with an outer, radially extending, mounting flange 70 which seats adjacent shoulder 58 and can be held thereagainst by an elastomeric gasket 72 press-fitted into the cap 20 against flange 70 as shown.

The cylindrical boss 68 is eccentric to the central axis of the insert member 64 and extends upwardly from an upper surface 74 thereof which abuts the bottom or inlet end 22 of lower body portion 28.

Extending downwardly from flange 70 is a cylindrical formation 76 having a cavity 78 therein and a mound portion 80 which is opposite cylindrical boss 66 and eccentric of the center of cylindrical formation 76. A first bore 82 is formed in the mound portion 80 and extends upwardly into the insert member 64. A second bore 84 extends downwardly into the cylindrical boss 68 opposite first bore 82 ahd in general alignment, preferably coaxial therewith. A third smaller-in-diameter bore 88 extends between and communicates with the first and second bore 82 and 84 within the insert member 64.

Press-fitted within the first bore 82 is a dip tube 88 which extends downwardly into the container 26.

As will be described hereinafter, the second bore 84 comprises part of a one-way check valve assembly 90.

For venting the container 26, a vent passage 92 extends between cavity 78 and upper surface 74 of insert member 64. A relief area 94 is formed in the upper surface 74 and communicates through lower body portion 28 to a forward portion of cavity 44. This communication is normally covered by piston 34 but is open to the ambient environment for allowing air into the container 26 as liquid is dispersed therefrom when the piston 34 is moved into the cavity 44. A similar vent structure is disclosed in the Steyns U.S. Pat. No. 4,072,252 which is assigned to the assignee of this patent application, AFA Corporation of Hialeah, Fla.

The cylindrical boss 66 extends in cavity 68 to a shoulder 95 and a smaller-in-diameter cavity extension 96 of cylindrical cavity 68 which extension 96 extends upwardly in body 12 into upper body portion 30. Here, in upper body portion 31, a horizontally extending passageway 97 communicates the cavity extension 96 with the nozzle assembly 14.

Returning to the one-way check valve assembly 90, such valve assembly 90 includes a ball 98 at a lower rounded or conical valve seat 100 in second bore 84, ribs 102 in second bore 84 limiting movement of ball 98, a ball 104 positioned on a rounded or conical valve seat 106 at the upper end of cylindrical boss 66, and a stop formation 108 depending from the upper end wall of cavity extension 96 for limiting upward movement of ball 104.

The valve assembly 90 together with trigger handle 16, piston 34, cavity 44 and spring 50, form a pump 120 which also includes a port 122 in a side wall of cylindrical boss 66 which communicates the second bore 84 with an opening 124 in body 12 between cavity 44 and cavity 68.

In operation of the pump 120, when trigger handle 16 is squeezed, piston 34 is pushed into cavity 44 to push fluid in cavity 44 through opening 124 and port 122 and against ball 104, moving ball 104 upwardly so that the expressed fluid flows through cavity extension 96 and horizontal passageway 97 to nozzle assembly 14 at the same time container 26 is vented.

Then, when trigger handle 16 is released, spring 50 pushes piston 34 out of cavity 44 creating a vacuum in second bore 84 which draws liquid up through dip tube 88, third bore 86, past ball 92 and through second bore 84, port 122, opening 124 and into cavity 44 ready to be dispensed, i.e. sprayed on the next squeezing of trigger handle 16.

To minimize, if not altogether prevent, malfunction of pump 120, a guide post 130 extends horizontally from the rear end of cavity 44 for receiving and guiding spring 50 at one end thereof. Then, piston 34 has an annular cavity 132 extending into the inner end portion 42 thereof to form a guide pin 134 therein around which the other end of spring 50 is received. The length of port 130 on pin 134 can be varied to provide a metering function, i.e. to increase or decrease the effective stroke of piston 34 and the amount of fluid dispensed on each "trigger squeeze".

The inner end portion 42 of piston 34 has a special configuration which is generally annular in shape and of larger diameter than the body of piston 34. The annular inner end portion 42 has a concave, arcuate in cross-section, annular groove extending between a forward flared annular ridge and a rearward flared annular ridge. Each of the ridges has a diameter slightly greater than the diameter of the cavity 44 to provide a frictional/sealing fit of the annular inner end formation 42 of piston 34 in cavity 44. To facilitate flexing of the annular ridges, the inner end portion 42 has a frustoconical opening extending outwardly from the annular cavity 132 toward the rearward annular ridge. Then an axially facing annular groove is provided at the forward end of the annular inner end formation 42 radially inwardly of the forward annular ridge. Also, to facilitate insertion of the inner end formation or portion 42, cavity 44 has a chamfer 135 where it opens on the front side 46 of lower body portion 28.

Engagement of pin 134 with post 130 or engagement of the rear edge of inner end portion 42 with the rear end of cavity 44 limits the inward stroke of piston 34 on the squeezing of trigger handle 16.

On the other hand, engagement of an upper shoulder 136 of trigger handle 16 with an underside 138 of a nose bushing 140 which forms part of nozzle assembly 14 and which is situated beneath the upper body portion 30, limits the outer stroke of piston 34.

Turning now to nozzle assembly 14, it will be appreciated that the nozzle assembly 14 has an off position, a stream and a spray mist position and includes the nose bushing 140 which has a cylindrical section 141 that is received partly in a part annular, horizontally extending, slot 142 in the outlet end 15 of the upper body portion 30 and about a cylindrical body section 143 which is coaxial with passageway 97. The nose bushing 140 further includes a forward formation 144 including an annular cavity 145 within an annular nozzle mounting portion 146 and about a center portion 147 which is eccentric to cylindrical section 141. The annular cavity 145 communicates with the passageway 96 and the center portion has an axial cavity 148. Ports 149 in the wall of center portion 147 communicate annular cavity 145 with axial cavity 148.

Then, nozzle assembly 14 further includes a stream nozzle 150 that has the off and stream and a spray mist position which has an outer cap formation 152 which is snap-fittingly received over the annular nozzle mounting formation 146 and an inner cap formation 154 which is received over the outer end of center portion 147. A stream forming orifice 156 coaxial with and extending through cap formations 152 and 154 communicates with axial cavity 148.

As an alternative to ports 149, the inner cap formation 154 can be formed with reliefs on the inner side wall thereof which can mate or not mate with reliefs on the cylindrical periphery of the center portion 147 to provide a two or three position nozzle assembly 14 with an OFF position, a MIST SPRAY position or a FLUID STREAM DELIVERY position, in a manner similar to that disclosed in U.S. Pat. No. 4,234,128.

Figure 3:
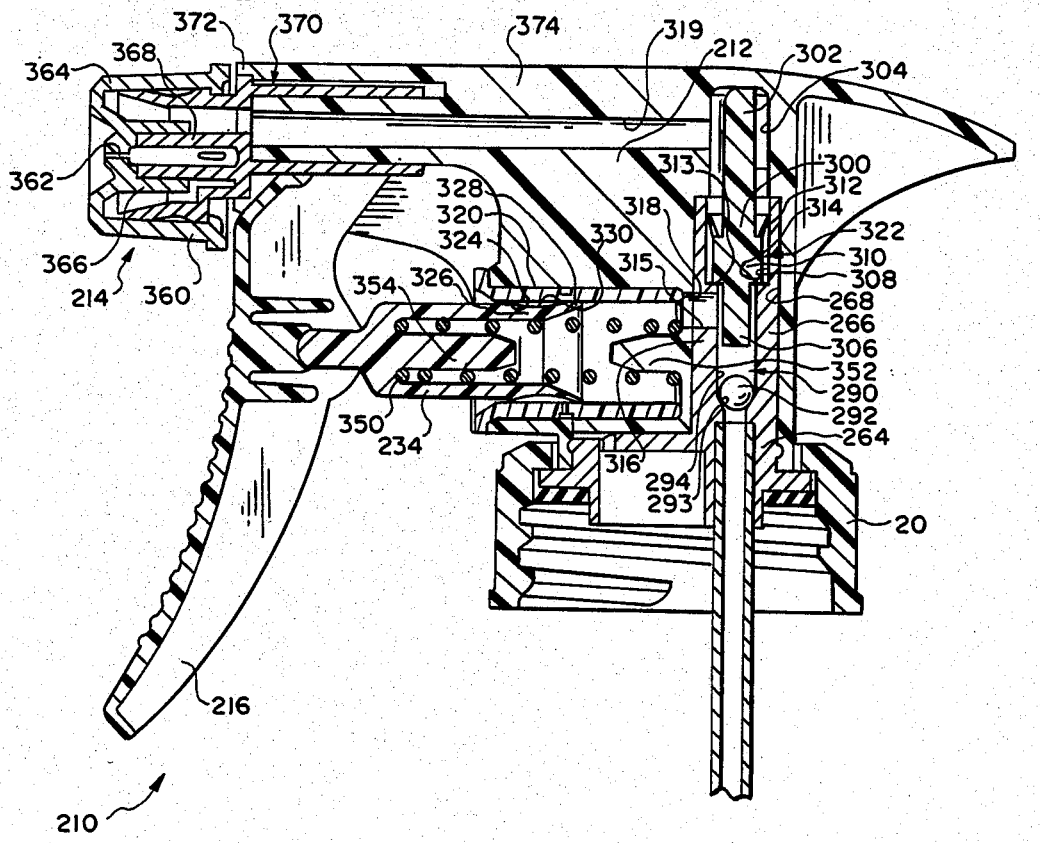
FIG. 3 is a vertical sectional view of another embodiment of the trigger sprayer shown in FIG. 1 and shows a valving system employing a ball and a conical skirt or umbrella, a smaller pumping piston than the pumping piston shown in FIG. 2 and an assembly which is totally interchangeable with the trigger sprayer assembly shown in FIG. 2.

Referring now to FIG. 3, there is illustrated therein, a modified trigger sprayer 210 which is similar in many respects to the trigger sprayer 10 shown in FIGS. 1 and 2. In this respect, the trigger sprayer 210 includes a body 212, which is identical to the body 12 shown in FIG. 1 and has a nozzle assembly 214 similar to the nozzle assembly 14, a trigger handle 216 identical to the trigger handle 16, a cap 220 identical to the cap 20, a piston 234 similar to but smaller than the piston 34, and a cylindrical cavity 244 identical to the cavity 44. The smaller piston 234 enables one to generate a greater amount of pressure per "trigger squeeze" which reduces the fluid output from the trigger sprayer 210 and allows the fluid to be expelled in a fine spray or mist.

In this embodiment, an insert member 264 similar to, but slightly different than, the insert member 64 is press-fitted into body 12. This insert member 264 has a cylindrical boss 266 like boss 66 received in a cylindrical cavity 268 identical to cavity 68 in body 212.

Also in this embodiment of the trigger sprayer 210, a modified valve assembly 290 is provided which includes a lower ball 292 seated at a conical valve seat 293 at the lower end of a second bore 294 in the cylindrical boss 266. However, instead of having an upper ball-like ball 104, this valve assembly 290 has a specially configured elongate valve member 300 which has an inverted umbrella shape and which has an upper rod portion 302 extending into a cavity extension 304 and a lower rod portion 306 which extends into the second bore 294 and forms a stop for limiting upward movement of the lower ball 292. The upper end of the second bore is countersunk or has a larger-in-diameter portion 308 into which is received an annular formation 310 of the valve member 300 located between the rod portions 302 and 306. This annular formation 310 has at the upper end thereof, a frusto-conical skirt or umbrella 312 which extends upwardly and radially outwardly from the annular formation 310 so as to engage the wall surface of the countersunk portion 308. A lower end of the annular formation 310 seats on a shoulder 313, and has slots 314 therein for communicating second bore 294 with countersunk portion 308.

Then, a port opening 315 is provided in a side wall 316 of the boss 266 and communicating the second bore 294 with an opening 318 in the body 212 between the cylindrical cavity 268 and the cavity 244.

In operation, when the trigger handle 216 is squeezed, piston 234 is moved within a sleeve 320 received in the cavity 244 to express fluid through the openings 318 and 315, and upwardly around the lower rod portion 366, through slots 314 into a space 322 between the annular formation 310 and the countersunk portion 308 and against the frusto-conical skirt 312 which is then deflected radially inwardly of the elongate valve member 300 to allow liquid to pass therearound and into the cavity extension 304 and then into a horizontally extending passageway 319 leading to the nozzle assembly 214.

It will be apparent that the difference between valve assembly 90 and valve assembly 290 is in the provision of the frusto-conical skirt 312 in place of the ball 104. This frusto-conical skirt 312 is like an inverted umbrella and the valve member 300 is referred to as an umbrella valve member 300.

Another difference between the trigger sprayer 210 and the trigger sprayer 10, is the provision of a different form of piston 234. Here, the piston 234, instead of having an inner end 42 with a larger-in-diameter annular formation as shown in FIG. 2, has essentially one continuous cylinder outer surface with a forward annular ridge 324 at the forward end of an inner end portion 326 and a rearward annular ridge 328, the annular ridges 324,328 being separated by an arcuate in cross-section annular groove 330.

Also, the piston 234 in this embodiment has a smaller outer diameter than piston 34 and portion 42 thereof and a sleeve insert 320 is provided within the cavity 244 to reduce the fluid volume in cavity 244 thereby to enable a greater pressure to be created on each "trigger squeeze" to produce a fine spray mist from the nozzle assembly 214.

Like in the trigger sprayer 10 shown in FIG. 2, a spring 350 is received in the cavity 244 over a guide post 352 at one end thereof and over a guide pin 354 within the piston 234 at the one end thereof.

Another difference in this embodiment, is the provision in the nozzle assembly 214 of a different type of nozzle 360. Here, nozzle 360 has a small orifice 362 extending through and coaxial with an outer cap formation 364 and an inner cap formation 366 so as to provide, with the increased pressure, a fine spray mist when the trigger handle 216 is squeezed. Again, the nozzle 360 can have an inner cap formation 366 which is specially configured with reliefs relative to reliefs on a center portion 368 of a nose bushing 370 mounted at forward end 372 of upper body portion 374 of the body 212 of the trigger spray 210 so that a two or three position nozzle assembly 214 is provided with at least an OFF and one SPRAY MIST position being provided.

From the foregoing description, it will be apparent, that the trigger sprayer 10 or 210 of the present invention has a number of advantages, some of which have been described above, and others of which are inherent in the invention.

First of all it is noted, that a common body 12 or 212 is provided which is adapted to receive at the outlet end 15 or 372, a common nozzle bushing 140 or 370 and a removable adjustable spray and fine mist nozzles 150 or 360 which have an OFF position as well to provide a closure function during shipping and between uses of the trigger sprayer 10 or 210. Likewise, the trigger handles 16 and 216 are identical and similar pistons 34 and 234 are utilized. Also, substantially identical insert members 64 and 264 are provided with one insert member 264 being modified to accommodate the umbrella valve member 300 having the frusto-conical skirt or umbrella 312.

Further, the special construction of piston inner end portions 42 and 326 provides a frictional, fluid tight, sliding engagement of piston 34 or 234 in cavity 44 or 244 with the portions 42 or 326 cooperating with a container vent system, such as defined by cavity 78, passageway 92, relief 99 and a passageway through body portion 28 to cavity 44.

Further, with the trigger sprayers 10 or 210 of the present invention, a number of different trigger sprayer assemblies can be assembled since the trigger sprayer 10 or 210 can utilize a standard piston 34 with the standard bore of thc cavity 44 or 244 or a high pressure piston 234 which is received within the bore in the insert member 264. Then two check valve assemblies are provided, namely the assembly 290 with the umbrella check valve 300 and the ball check valve 292 or a two-ball check valve assembly 90 with the ball 98 and the ball 104 .

Further, four nozzle assemblies can be provided; one being a standard spray nozzle with an OFF position, SPRAY position and STREAM position, or a standard spray nozzle with an OFF position and a SPRAY or STREAM position.

Alternatively, a fine spray mist nozzle assembly can be provided with the OFF, SPRAY and STREAM positions in one nozzle assembly or with OFF and SPRAY or STREAM positions in the other nozzle assembly.

With the various combinations that are possible, thirty-two different models of trigger sprayers can be created with the various sub-assemblies of the trigger sprayers 10 and 210 described above.

Additionally, modifications can be made to the trigger sprayer 10 or 210 without departing from the teachings of the invention. Accordingly, the scope of the invention is only to be limited as necessitated by the accompanying claims.

I claim:

1. A valve and pumping assembly for use in a trigger sprayer comprising:

a body having a bore therein including a linear passageway having first and second ends with said first end adapted for connection to a source of fluid to be dispensed and a second end adapted for connection to an outlet through which fluid is to dispensed, said passageway having a cylindrical wall, said wall having an opening therethrough for connection of the ends of said passageway to a pump chamber, said valve and pumping assembly comprising:

first check valve means in said passageway between said first end thereof and said opening for permitting forward flow of fluid from the source but not reverse flow to the source, second check valve means in said passageway adjacent said second end thereof for permitting forward flow of fluid to said outlet but not reverse flow to said pump chamber, said second check valve means comprising a stationary flexible frusto-conical shaped skirt member having outer marginal edges thereof in engagement with said cylindrical wall of said passageway, and pumping means comprising a piston received in said pump chamber, a spring in said pump chamber between an inner end thereof and an inner end of said piston for biasing said piston outwardly of said pump character, and trigger means which are pivotally connected to the body, which are engagable with an outer end of said piston and which are hand manipulatable for pushing said piston into said pump chamber against the action of said spring thereby to force fluid in said pump chamber from said pump chamber through said opening into said bore and past said second check valve means to the outlet, on a outer stroke of said piston, to draw fluid into said pump chamber from the source through said first check valve means.

2. The valve assembly of claim 1 wherein said first check valve means comprises a ball and an associated seat.

3. A trigger sprayer comprising a body having an upper generally horizontally extending portion and a lower generally vertically extending portion, said body having passage means therein extending from one end of said upper portion to the bottom of said lower portion for providing a fluid flow path through said body, a first cylindrical cavity extending into said lower body portion from the underside thereof, an insert member adapted to be received in said first cavity and having a passageway therethrough communicating with said body passage means, means for coupling the lower end of said insert member to a container of fluid, a check valve assembly associated with said passageway including lower check valve means for permitting fluid flow upwardly therethrough from the container to which said insert member is coupled, and upper check valve means for permitting fluid flow upwardly through said passage means to said one end of said upper body portion, and pumping means mounted to said body and communicating with said passageway between said upper and lower check valve means, said lower body portion having a second generally cylindrical cavity therein, said body insert member having second passage means therethrough communicating the interior of said second cylindrical cavity with said passageway and said insert member, and said pumping means comprising a piston received in said second cavity, a spring in said second cavity between an inner end thereof and an inner end of said piston for biasing said piston outwardly of said second cavity, and trigger means which are pivotally connected to said body and engagable with an outer end of said piston and which are hand manipulatable for pushing said piston into said second cavity against the action of said spring thereby to force fluid in said second cavity, on an inner stroke of said piston, from said second cavity into said passageway and past said upper check valve means to said one end of said upper body portion, and on an outer stroke of said piston, to draw fluid into said second cavity from the container through said lower check valve means.

4. The trigger sprayer of claim 3 wherein said lower check valve means is defined by a ball and a valve seat in said passageway on which said ball is seated.

5. The trigger sprayer of claim 3 wherein said upper check valve means is defined by a ball and a valve seat at the upper end of the portion of said insert member received in said first cylindrical cavity in said lower body portion.

6. The trigger sprayer of claim 3 wherein said upper check valve means is defined by an elongate valve member having an upper rod portion and a lower rod portion, said lower rod portion extending into said passageway and forming a stop for limiting a valve element of said lower check valve means, said passageway having a larger-in-diameter upper portion through which said valve member extends; and said valve member has an annular formation received in said larger-in-diameter portion passageway portion, said annular formation having an outer diameter less than the diameter of said larger-in-diameter passageway portion, and a frusto-conical skirt extending axially upwardly and radially outwardly from said annular formation in said larger-in-diameter portion of said passageway, and frictionally and sealingly engaging the wall thereof, said frusto-conical skirt being deflectable under fluid pressure for allowing fluid to pass axially upwardly to said passage means in said body.

7. The trigger sprayer of claim 3 wherein said passageway through said insert member comprises a first lower bore, a second upper bore and a third smaller-in-diameter bore therebetween, a dip tube has one end press fitted into said first bore and another end depending downwardly into the container, and the lower end of said second bore being rounded to form a valve seat for said lower check valve means.

8. The trigger sprayer of claim 3 wherein said insert member includes a radially extending flange at the lower end thereof which is received within a cap for coupling said cap to said body, and an annular elastomeric washer is press fitted into the cap against said flange for forming a fluid tight seal between said insert member and the interior of said cap which is adapted to be connected to an outlet opening of the container.

9. The trigger sprayer of claim 3 wherein said upper check valve means is defined by an elongate valve member having an upper rod portion and a lower rod portion, said lower rod portion extending into said passageway and forming a stop for limiting a valve element of said lower check valve means, said passageway having a larger-in-diameter upper portion through which said valve member extends; and said valve member has an annular formation received in said larger-in-diameter passageway portion, said annular formation having an outer diameter less than the diameter of said larger-in-diameter passageway portion, and a frusto-conical skirt extending axially upwardly and radially outwardly from said annular formation in said larger-in-diameter portion of said passageway, and frictionally and sealingly engaging the wall thereof, said frusto-conical skirt being deflectable under fluid pressure for allowing fluid to pass axially upwardly to said passage means in said body.

10. The trigger sprayer of claim 3 wherein said inner end of said second cavity has a guide post extending axially of said second cavity for receiving one end of said spring thereon, and said piston has a guide pin on the inner end thereof for receiving and guiding the other end of said spring, the distance between the outer ends of said pin and said post defining the stroke of said piston such that length of said pin and said post provide a metering function and control the amount of fluid dispensed on each squeezing of the trigger.

11. The trigger sprayer of claim 3 wherein said passage means within said body includes said first cylindrical cavity in which said insert member received, a cavity extension extending upwardly therefrom and a horizontal passageway extending between said cavity extension and said one end of said upper body portion and opening onto said one end of said upper body portion.

12. The trigger sprayer of claim 3 wherein said insert member has a first vent passageway therein from the lower end thereof to and beneath the bottom of said lower body portion and in communication with a second vent passageway through said body portion opening into said second cavity in the area of said piston, said second vent passageway being open to the ambient environment on the completion of an inner stroke of said piston for venting the interior of the container.

13. The trigger sprayer of claim 3 wherein said trigger means includes a trigger handle pivotally mounted to said body and having a rounded seat and guide formation on a back side thereof for sliding engagement with a rounded outer end of said piston.

14. The trigger sprayer of claim 3 wherein said second cylindrical cavity extends generally parallel to said upper body portion in a generally horizontal direction.

15. The trigger sprayer of claim 3 wherein said inner end of said piston has an annular formation specially configured for frictionally and sealingly engaging the inner surface of said second cavity, or a sleeve insert in said second cavity.

16. The trigger sprayer of claim 15 wherein said special formation at the inner end of said piston comprises a first forward annular ridge located on the outer surface of said piston and having a diameter greater than the inner diameter of said second cavity, or a sleeve insert therein, a rearward annular ridge having a diameter greater than the inner diameter of said second cavity or sleeve insert therein, and an arcuate in cross-section annular groove around said annular formation between said ridges.

17. The trigger sprayer of claim 3 wherein said lower body portion has a cylindrical hollow in the lower end thereof and said first cylindrical cavity extends upwardly from an inner surface of said hollow.

18. The trigger sprayer of claim 17 wherein said insert member has a cylindrical boss which is press fitted within said first cylindrical cavity, and said cylindrical boss is eccentric to the central axis of said cylindrical hollow.

19. The trigger sprayer of claim 17 wherein said cylindrical hollow has an annular groove therein and said insert member has an annular detente on an outer surface thereof which is snap-fittingly received in said annular groove in said cylindrical hollow.

20. The trigger sprayer of claim 3 including a nozzle assembly coupled to said one end of said upper body portion.

21. The trigger sprayer of claim 20 wherein said nozzle assembly includes a specially configured nozzle bushing mounted to said one end of said upper body portion and an adjustable replaceable nozzle snap-fittingly mounted on a forward end of said nozzle bushing.

22. The trigger sprayer of claim 21 wherein said nozzle comprises an outer cap formation received over and snap-fittingly mounted on said forward end of said nozzle bushing and an inner cap formation received over a center portion of said forward end of said nozzle bushing, said center portion having an axial cavity therein and said nozzle having a metering orifice extending through said cap formations and communicating with said axial cavity.

23. The trigger sprayer of claim 22 wherein said nozzle is rotatable on said center portion between two positions of said nozzle.

24. The trigger sprayer of claim 23 wherein said nozzle has an off position and a spray mist position or a stream discharge position.

25. The trigger sprayer of claim 22 wherein said nozzle is rotatable on said center portion between three positions of said nozzle.

26. The trigger sprayer of claim 25 wherein said nozzle has an off position, a spray mist position and a stream discharge position.

* * * * *